US011725658B2

(12) United States Patent
Li

(10) Patent No.: US 11,725,658 B2
(45) Date of Patent: Aug. 15, 2023

(54) SCREW COMPRESSOR WITH MALE AND FEMALE ROTORS

(71) Applicants: Johnson Controls Air Conditioning and Refrigeration (Wuxi) Co., Ltd., Wuxi (CN); Johnson Controls Technology Company, Auburn Hills, MI (US)

(72) Inventor: Haijun Li, Wuxi (CN)

(73) Assignees: Johnson Controls Air Conditioning and Refrigeration (Wuxi) Co., Ltd., Jiangsu (CN); Johnson Controls Tyco IP Holdings LLP, Milwaukee, WI (US)

( * ) Notice: Subject to any disclaimer, the term of this patent is extended or adjusted under 35 U.S.C. 154(b) by 923 days.

(21) Appl. No.: 16/322,448

(22) PCT Filed: Aug. 1, 2017

(86) PCT No.: PCT/CN2017/095491
§ 371 (c)(1),
(2) Date: Jan. 31, 2019

(87) PCT Pub. No.: WO2018/024201
PCT Pub. Date: Feb. 8, 2018

(65) Prior Publication Data

US 2021/0372401 A1 Dec. 2, 2021

(30) Foreign Application Priority Data

Aug. 2, 2016 (CN) ..... 201620827063.9

(51) Int. Cl.
*F04C 18/16* (2006.01)
*F04C 18/20* (2006.01)
*F04C 18/08* (2006.01)

(52) U.S. Cl.
CPC ..... *F04C 18/16* (2013.01); *F04C 18/084* (2013.01); *F04C 18/20* (2013.01)

(58) Field of Classification Search
CPC ..... F04C 18/084; F04C 18/16; F04C 18/20
See application file for complete search history.

(56) References Cited

U.S. PATENT DOCUMENTS 2,410,172 A * 10/1946 Lysholm ..... F04C 18/16 418/91
3,097,359 A * 7/1963 Cowles ..... F04C 18/16 418/203

(Continued)

FOREIGN PATENT DOCUMENTS

CN 1793654 A 6/2006
CN 202250858 U 5/2012

(Continued)

OTHER PUBLICATIONS

Machine Translation of Chinese Patent Publication: CN 102996450 A, Title: Semi-enclosed double-screw compressor, inventors: Jihong et al, Publication Mar. 27, 2013. (Year: 2013).*

(Continued)

*Primary Examiner* — Mary Davis
(74) *Attorney, Agent, or Firm* — Fletcher Yoder, PC

(57) ABSTRACT

The present application provides a screw compressor that comprises a first male rotor and a second male rotor, each of the first male rotor and the second male rotor having convex-helical teeth, the first male rotor and the second male rotor being rigidly connected together; a first female rotor and a second female rotor, each of the first female rotor and the second female rotor having concave-helical teeth, the first female rotor being arranged separately from and opposite to each other; wherein the convex-helical teeth of the first male rotor are engaged with the concave-helical teeth of the first female rotor, and the convex-helical teeth of the (Continued)

second male rotor are engaged with the concave-helical teeth of the second female rotor. The male rotors in the screw compressor are symmetrically so that the axial force exerted on the first male rotor counteract with the axial force exerted on the second male rotor.

17 Claims, 8 Drawing Sheets

(56) References Cited

U.S. PATENT DOCUMENTS

| | | | | |
|---|---|---|---|---|
| 3,279,682 | A * | 10/1966 | Vagenius | F04C 18/16 418/9 |
| 3,467,300 | A | 9/1969 | Schibbye | |
| 4,462,769 | A | 7/1984 | Schibbye et al. | |
| 5,653,585 | A | 8/1997 | Fresco | |
| 6,186,758 | B1 | 2/2001 | Shaw | |
| 2008/0085207 | A1 | 4/2008 | Mosemann et al. | |
| 2016/0040670 | A1 | 2/2016 | Pillis et al. | |

FOREIGN PATENT DOCUMENTS

| | | | |
|---|---|---|---|
| CN | 202360394 | U | 8/2012 |
| CN | 102996450 | A | 3/2013 |
| CN | 105805002 | A | 7/2016 |
| CN | 205618356 | U | 10/2016 |
| CN | 205937114 | U | 2/2017 |
| DE | 19820622 | A1 | 11/1999 |
| JP | S60249689 | A | 12/1985 |

OTHER PUBLICATIONS

Machine translation of Japanese Patent Publication JP 60-249689, Inventor: Mitani et al, Title: Screw Compressor, Published Dec. 10, 1985. (Year: 1985).*

Foreign Patent with English Machine translation for Chinese Patent Publication CN 103807178 A; Inventors: Chiba, Takano, and Sumi, Title: Screw Compressor; Published: May 21, 2014. (Year: 2014).*

International Search Report and Written Opinion for PCT Application No. PCT/CN2017/095491 dated Oct. 11, 2017, 10 pgs.

* cited by examiner

SCREW COMPRESSOR WITH MALE AND FEMALE ROTORS

CROSS-REFERENCE TO RELATED APPLICATIONS

This application is a U.S. National Stage Application of PCT International Application No. PCT/CN2017/095491, entitled "A SCREW COMPRESSOR WITH MALE AND FEMALE ROTORS," filed Aug. 1, 2017, which claims priority from and the benefit of Chinese Patent Application No. 201620827063.9, filed Aug. 2, 2016, each of which is hereby incorporated by reference in its entirety for all purposes.

TECHNICAL FIELD

The present application generally relates to the field of refrigerating and air-conditioning, and more particularly to a screw compressor with male and female rotors which is used in refrigerating and air-conditioning.

BACKGROUND

Screw compressors have a wide application in the field of refrigerating and air-conditioning due to their wide applicability and high reliability. It is known that a load on a screw compressor is most suitable only when the screw compressor is designed for a working condition. However, in actual operation, loads on the rotors of the screw compressors vary greatly due to different application demands and working conditions.

FIG. 1 shows a conventional screw compressor 100 that has a female rotor 110 and a male rotor 120. In the process in which the screw compressor is compressing gas medium, the gaseous refrigerant is compressed from low pressure into high pressure, such that the refrigerant pressure increases gradually from a low entry pressure to a high discharge pressure when the gaseous refrigerant moves from the inlet 121 to the outlet 122 of the screw compressor 100. As a result, a force along the axial direction from the outlet 122 to the inlet 121 is exerted on the male rotor 120. Usually, cylindrical roller bearings 123 are provided at the respective ones of two ends 120 of the helical male rotor 120 to bear the force along the radial direction, while thrust bearings 124 are provided at end of the male rotor 120 to bear the force along the axial direction.

Because the working conditions of refrigerating screw compressors vary greatly, the axial force exerted on the helical rotors designed for such a screw compressor also vary greatly. When the discharge pressure and the entry pressure of the screw compressor differ greatly, the axial force exerted on the rotors will be tremendous accordingly. Especially for the male rotor 120, the axial force possibly exceeds the design load for the thrust bearing of the screw compressor, which may reduce the life of the thrust bearing; or in worse cases, the axial force may even damage the thrust bearing, causing failure because the helical rotors stuck within the body of the screw compressor. However, when the difference between the discharge pressure and the entry pressure is very small, the axial force exerted on the helical rotors will also be very small, even being possibly smaller than the minimum load needed by the thrust bearings of the screw compressor, causing slippage of the balls in the thrust bearings. To prevent over-load on the thrust bearing of the male rotor 120 under a working condition with high pressure-difference, some screw compressors are designed to provide a balancing piston at the male rotor 120 side so as to balance a portion of the axial force. However, such an approach cannot fully solve the variation issue of the axial force, especially cannot solve the slippage issue of the thrust bearings when the load on the compressor is too small.

Therefore, there is a need for an improved screw compressor that can solve some or all of the above mentioned shortcomings in the traditional compressors.

SUMMARY

The present application provides a screw compressor that comprises: a first male rotor and a second male rotor, each of the first male rotor and the second male rotor having convex-helical teeth, the first male rotor and the second male rotor being rigidly connected together; a first female rotor and a second female rotor, each of the first female rotor and the second female rotor having concave-helical teeth, the first female rotor being arranged separately from and opposite to each other; wherein the convex-helical teeth of the first male rotor are engaged with the concave-helical teeth of the first female rotor, and the convex-helical teeth of the second male rotor are engaged with the concave-helical teeth of the second female rotor.

The screw compressor above, wherein a first compressing channel is formed between the first male rotor and the first female rotor, the first compressing channel has a first inlet and a first outlet, a first stream of medium flows through the first compressing channel in a first flow direction from the first inlet to the first outlet; a second compressing channel is formed between the second male rotor and the second female rotor, the second compressing channel has a second inlet and a second outlet, a second stream of medium flows through the second compressing channel in a second flow direction from the second inlet to the second outlet; the first flow direction is opposite to the second flow direction.

The screw compressor above, wherein: the first stream of medium generates a first axial force that is exerted on the first male rotor when the first stream of medium is being compressed in the first compressing channel; the second stream of medium generates a second axial force that is exerted on the second male rotor when the second stream of medium is being compressed in the second compressing channel; the first axial force and the second axial force are opposite to each other.

The screw compressor above, wherein the first male rotor and the second male rotor being rigidly connected together by rigid shaft coupling or rigid union joint, by welding or by being made as one piece.

The screw compressor above, wherein the first stream of medium and the second stream of medium flow towards to or flow away from each other.

The screw compressor above, wherein the medium is refrigerant.

The screw compressor above, wherein the first stream of medium and the second stream of medium are introduced from an evaporator and sent to a condenser after being compressed by the screw compressor.

The screw compressor above, wherein when the first male rotor and the second male rotor rotate in a first rotation direction, the first female rotor and the second female rotor are driven by the first male rotor and the second male rotor to rotate in a second rotating direction, the first rotation direction is opposite to the second rotation direction.

The screw compressor above, wherein the first male rotor, the second male rotor, the first female rotor and the second female rotor are enclosed in a housing in a sealed condition.

The screw compressor above, wherein the two ends of the first male rotor and the second male rotor are amounted on two roller bearings, respectively; the two ends of the first female rotor and the second female rotor are amounted on two roller bearings, respectively.

The screw compressor above, wherein one of the two ends of the first female rotor and the second female rotor is amounted on thrust bearings.

The screw compressor above, further comprises:

a motor that is amounted on the shaft between the first male rotor and the second male rotor.

The present application also provides a refrigeration air-conditioning unit that comprises:

a screw compressor that is made according to any one of the above defined screw compressor.

BRIEF DESCRIPTION OF THE DRAWINGS

The drawings below are for understanding the present application. The embodiments and depictions thereof as illustrated in the drawings are for explaining the principle of the present application. In the drawings.

DETAILED DESCRIPTION OF EMBODIMENTS

Hereinafter, details are provided for understanding of the present application. However, those skilled in the art would appreciate that the present application may be implemented with variations of these details. It needs to be noted that the terms "upper," "lower," "front," "rear," "left," "right," and similar directional expressions used herein are only for illustration purposes, not intended for limiting. In the accompany drawings, similar or same components use the same reference numbers to simplify descriptions of the present application.

The sequential numerals such as "first" and "second" referenced in the present disclosure are only for identifying, without any limiting (such as a specific sequence). Moreover, the term "a first component" itself does not imply existence of "a second component," and the term "a second component" does not imply existence of "a first component."

Figure 1:
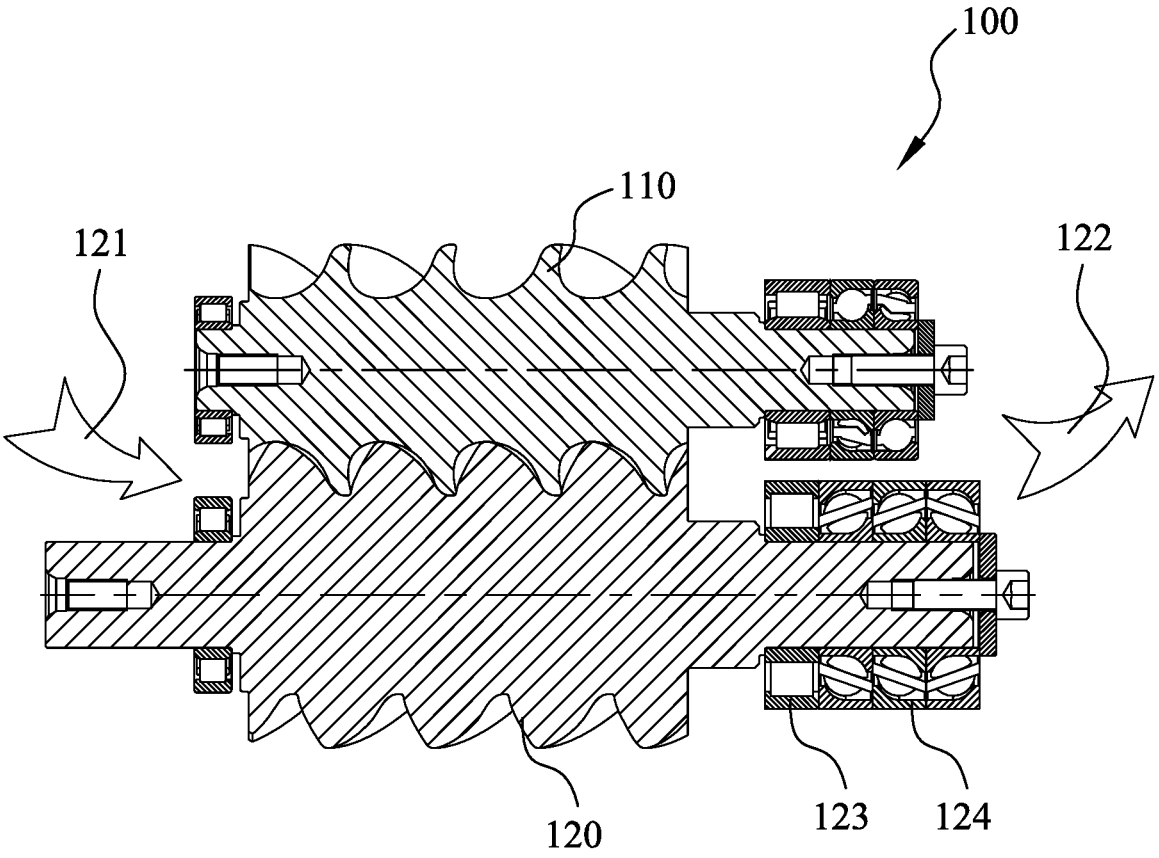
Figure 1 Prior Art
FIG. 1 shows a conventional screw compressor 100.
Figure 2A:
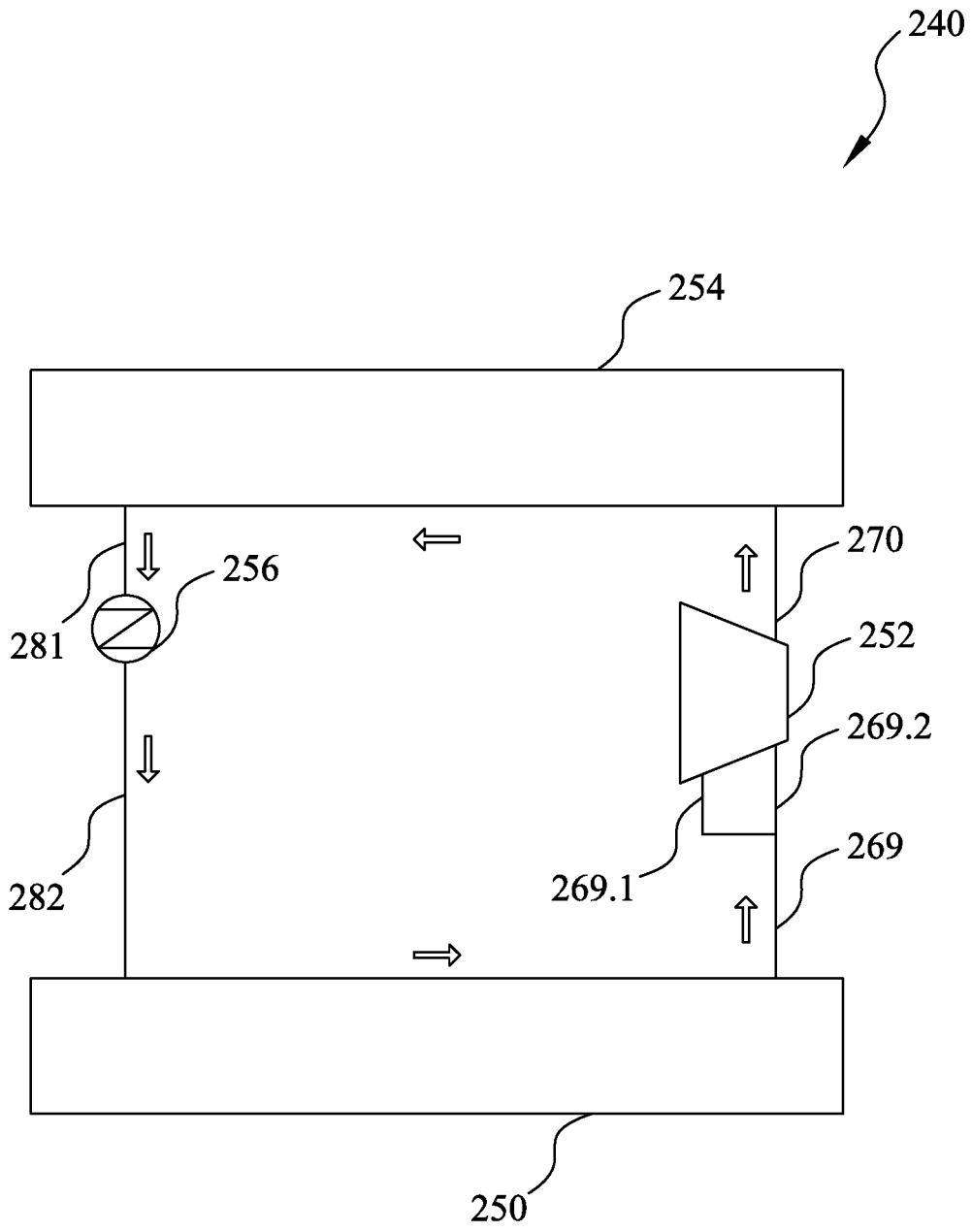
FIG. 2A shows an illustrative block diagram of a refrigeration air-conditioning unit 240 according to the first embodiment in the present application.

FIG. 2A shows an illustrative block diagram of a refrigeration air-conditioning unit 240 according to the first embodiment in the present application, in which the screw compressor 252 is used according to the present application. As shown in FIG. 2A, the refrigeration air-conditioning unit 240 includes four components, namely, evaporator 250, compressor 252, condenser 254 and throttling apparatus 256. The four components are fluently connected by pipe lines and medium (such as refrigerant) is circulated through the four components via these pipe lines. In the first embodiment of the refrigeration air-conditioning unit 240, the evaporator 250 is connected to a pipe 269, which is divided into two pipes of 269.1, 269.2 that are in turn connected to compressor 252. In operation, the evaporator 250 contains refrigerant in gaseous-liquid mixture format and changes the refrigerant mixture into gaseous format. The gaseous refrigerant is then introduced in to the compressor 252 via the pipe 269, where the pipe is divided into 269.1, 269.2 that are connected to the compressor 252. In the compressor 252, the gaseous refrigerant is compressed into high-pressure refrigerant gas, which is further introduced into the condenser 254. The condenser 254 changes the high-pressure refrigerant gas into liquid format, and the liquid refrigerant is then introduced into the throttling apparatus 256 via pipe 281. The throttling apparatus 256 converts the liquid refrigerant to gaseous-liquid mixture format again, and the gaseous-liquid mixture is led back to the evaporator 250 via pipe 282. The above process is repeated among the four components during the operation of the refrigeration air-conditioning unit 240.

Figure 2B:
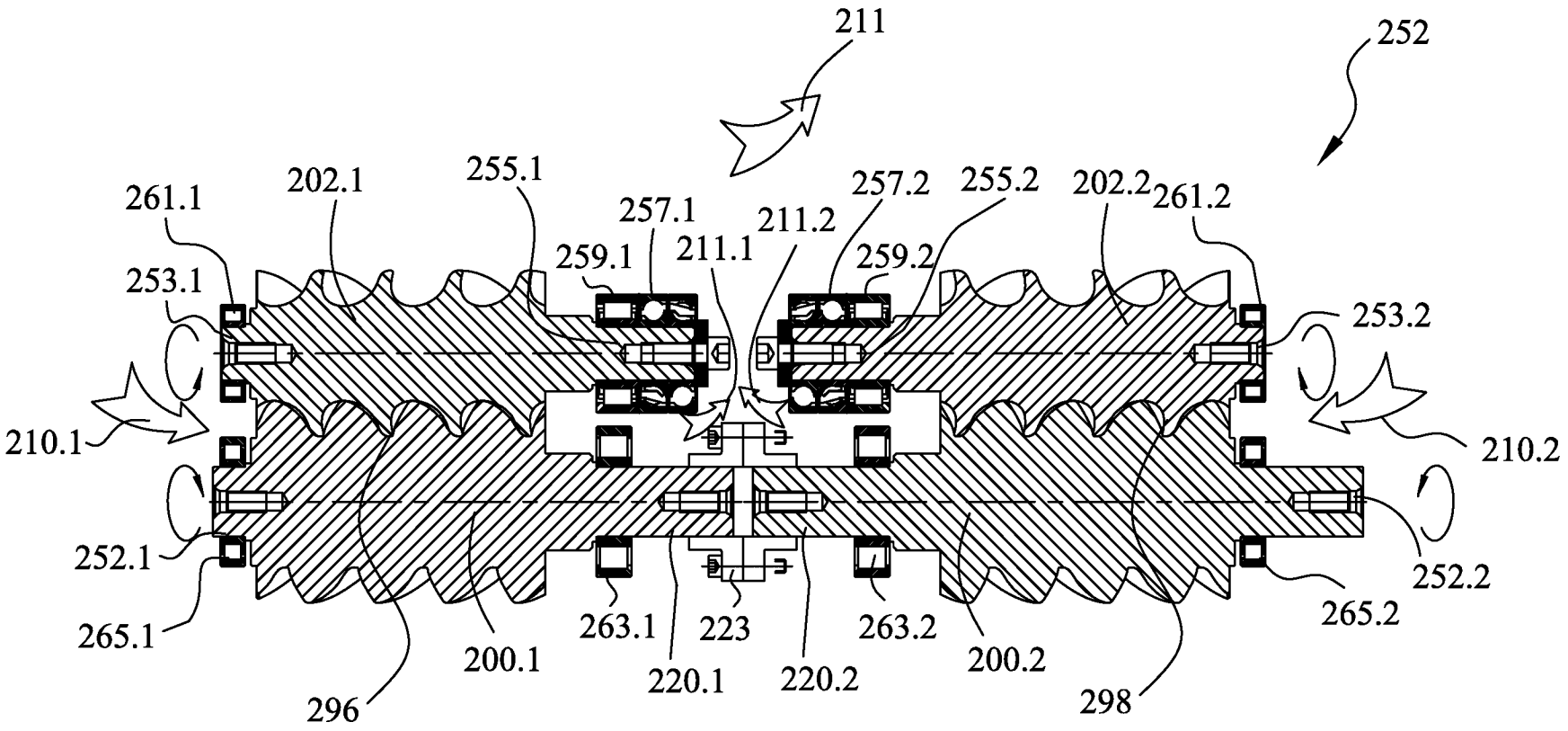
FIG. 2B shows the compressor 252 of FIG. 2A in greater detail according to the first embodiment in the present application.

FIG. 2B shows the compressor 252 of FIG. 2A in greater detail according to the first embodiment in the present application. As shown in FIG. 2B, the screw compressor 252 comprises two male rotors 200.1, 200.2 and two female rotors 202.1, 202.2. The two female rotors 202.1, 202.2 and the two male rotors 200.1, 200.2 are oppositely disposed and symmetrically arranged, respectively.

In FIG. 2B, roller bearings 265.1, 263.1 are installed at the entry end 252.1 and the discharge end 220.1 of the male rotor 200.1, respectively; roller bearings 265.2, 263.2 are installed at the entry end 252.2 and the discharge end 220.2 of the male rotor 200.2, respectively; roller bearings 261.1, 259.1 are installed at the entry end 253.1 and the discharge end 255.1 of the female rotor 202.1, respectively; roller bearings 261.2, 259.2 are installed at the entry end 253.2 and the discharge end 255.2 of the female rotor 202.2, respectively; thrust bearings 257.1, 257.2 are installed, in parallel with roller bearings 259.1, 259.2, at the discharge ends 255.1, 255.2 of the female rotors 202.1, 202.2, respectively. The two male rotors 200.1, 200.2 and two female rotors 202.1, 202.2 are rotationally supported by these bearings.

More specifically, an inlet 210.1 and an outlet 211.1 are disposed at the two ends of the male rotor 200.1 and the female rotor 202.1; an inlet 210.2 and an outlet 211.2 are disposed at the two ends of the male rotor 200.2 and the female rotor 202.2. The entry end 252.1 of the male rotor 200.1 and entry end 253.1 of the female rotor 202.1 are located at the inlet 210.1; the entry end 252.2 of the male rotor 200.2 and entry end 253.2 of the female rotor 202.2 are located at the inlet 210.2; the discharge end 220.1 of the male rotor 200.1 and discharge end 255.1 of the female rotor 202.1 are located near the outlet 211.1; the discharge end 220.2 of the male rotor 200.2 and discharge end 255.2 of the female rotor 202.2 are located near the outlet 211.2. The two male rotors 200.1, 200.2 are co-axially rigidly coupled on the discharge ends 220.1, 220.2 of the male rotors 200.1, 200.2. As one embodiment, the discharge ends 220.1, 220.2 of the two male rotors 200.1, 200.2 are rigidly coupled together by using rigid shaft coupling or rigid union joint 223, such that the outlets 211.1, 211.2 are combined as a combined outlet 211 at the discharge ends 220.1, 220.2 of the two male rotors 200.1, 200.2 and the discharge ends 255.1, 255.2 of the two female rotors 202.1, 202.2. In this arrangement, the forces exerted on the two male rotors 200.1, 200.2 along an axial direction counteract with each other during the operation of the screw compressor 252.

In other words, an axial force excreted on male rotor 200.1 is directed from its discharge end 220.1 towards its entry end 252.1 and an axial force exerted on the male rotor 200.2 is directed from its discharge end 220.2 towards its entry end 252.2. The directions of these two forces are opposite and counteract to each other because the two male rotors 220.1, 220.2 are fixedly and rigidly coupled with each other. The counteraction of the two axial forces can save the thrust bearings on the two male rotors 200.1, 200.2, thereby reducing the manufacturing cost of the screw compressor. Moreover, by saving the thrust bearings, the screw compressor can run stably and smoothly even in a high pressure-difference working condition without the problem of overload to the thrust bearings, thereby improving the reliability of the screw compressor in the present application. Further, in a low pressure-difference working condition, slippage caused by under-load (meaning the load is lower than the required load) on the thrust bearings can be avoided, which also improves the reliability of the screw compressor in the present application. Also, with counteraction of the two axial forces, a balancing piston at the male rotors can be saved, thus further reducing the cost and improving the durability of the compressor in the present application.

Figure 2C:
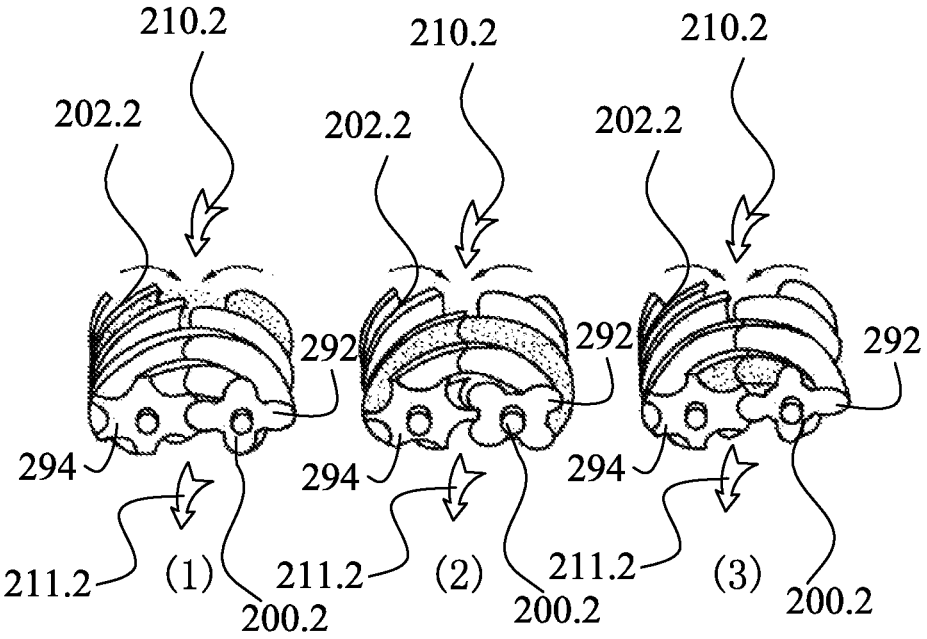
FIGS. 2C (1)-(3) show the helical teeth on the male rotor 200.2 and female rotor 202.2 in greater details according to one embodiment in the present application.

FIGS. 2C (1)-(3) show the helical teeth on the male rotor 200.2 and female rotor 202.2 in greater details according to one embodiment in the present application. As shown in FIGS. 2C (1)-(3), the male rotor 200.2 contains four convex-helical teeth 292 and the female rotor 202.2 contains six concave-helical teeth 294. The four convex-helical teeth 292 on the male rotor 200.2 engage with the six concave-helical teeth 294 on the female rotor 202.2 while the male rotor 200.2 rotates in counter clockwise direction, which drives the female rotor 202.2 to rotate in clockwise direction. When in a sealed condition by a housing (see FIG. 2D), with the engagement between the four convex-helical teeth 292 and six concave-helical teeth 294, four chambers (which can be deemed as a second compress channel 298) are formed between the four convex-helical teeth 292 and the six concave-helical teeth 294 when the male rotor 200.2 and the female rotor 202.2 are rotating. The four convex-helical teeth 292 on the male rotor 200.2 and the six concave-helical teeth 294 on the female rotor 202.2 are designed such that, during the rotation of the male rotor 200.2 and the female rotor 202.2, the refrigerant is sucked into the inlet 210.2 of the chambers, is being compressed within the compress chambers while moving from the inlet 210.2 to the outlet 211.2 of the compress chambers and is pushed out of the outlet 211.2 where the refrigerant is compressed as high pressure refrigerant. FIG. 2C(1) shows that the refrigerant is sucked into the inlet 210.2; FIG. 2C(2) shows that the refrigerant is being compressed in one of the four compress channels or chambers while moving from the inlet 210.2 to the outlet 211.2; FIG. 2C(3) shows that refrigerant is pushed out of the outlet 211.2 where the refrigerant is compressed as high pressure refrigerant. In FIGS. 2C (1)-(3), the blackened portions in the drawings indicate that the refrigerant is being compressed while moving from the inlet 210.2 to the outlet 211.2.

A person skilled in the art would understand that the male rotor 200.1 and female rotor 202.1 are designed by using the same principle as described in connection with FIGS. 2C(1)-(3). Specifically, the four convex-helical teeth 292 on the male rotor 200.1 engage with the six concave-helical teeth 294 on the female rotor 202.2 while the male rotor 200.1 rotates in counter clockwise direction, which drives the female rotor 202.1 to rotate in clockwise direction. The four convex-helical teeth 292 on the male rotor 200.1 and the six concave-helical teeth 294 on the female rotor 202.1 are designed such that, during rotation of the male rotor 200.1 and the female rotor 202.1, the refrigerant is sucked into the inlet 210.1 of the four compress channels or chambers (which can be deemed as a first compress channel 296), is being compressed within the compress channels or chambers while moving from the inlet 210.1 to the outlet 211.1 and is pushed out of the outlet 211.1 where the refrigerant is compressed as high pressure refrigerant.

Figure 2D:
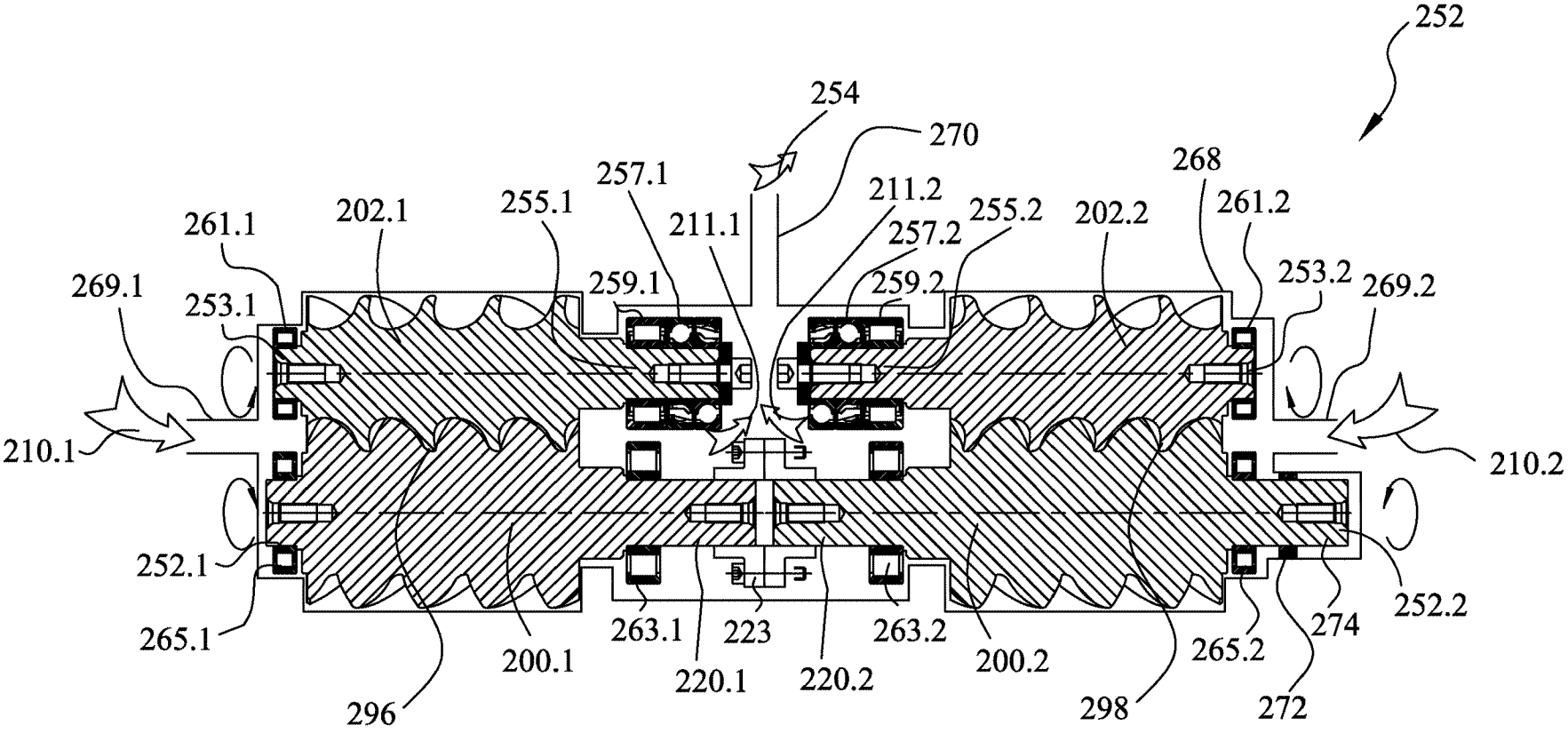
FIG. 2D shows the compressor 252 of FIG. 2A in greater detail according to the second embodiment of the present application.

FIG. 2D shows the compressor 252 of FIG. 2A in greater detail according to the second embodiment of the present application. As shown in FIG. 2D, the two male rotors 200.1, 200.2 and two female rotors 202.1, 202.2 are installed in a housing 268, which encloses the two male rotors 200.1, 200.2 and two female rotors 202.1, 202.1 into a sealed environment. As shown in FIG. 2D, the housing 268 is connected to a pipe inlet 269.1, which is in turn connected to the pipe 269 shown in FIG. 2A, at the lateral side of the entry ends 252.1, 253.1 of the male rotor 200.1 and the female rotor 202.1; the housing 268 is also connected to the pipe 269.2, which is also in turn connected to the pipe 269 shown in FIG. 2A, at the lateral side of the entry ends 252.2, 253.2 of the male rotor 200.2 and the female rotor 202.2; the housing 268 is further connected pipe 270, which is connected to the condenser 254 shown in FIG. 2A, at the location above of the discharge ends 255.1, 255.2 of the female rotors 202.1, 202.2. To maintain the housing 268 in a sealed condition, a seal 272 is installed around the shaft 274, which is located at the entry end 252.2 of the male rotor 200.2 and is extended outside of the housing 268.

To describe the operation of the compressor 252, reference is still made to FIG. 2D. In operation, a motor (not shown) drives the shaft 274 so that the male rotors 200.1, 200.2 rotate in counter clockwise direction, which in turn drives the female rotors 202.1, 202.2 to rotate in clockwise direction through the engagements between the convex-helical teeth on the male rotors 200.1, 200.2 and the concave-helical teeth on the female rotors 202.1, 202.2. With the rotation of the male rotors 200.1, 200.2 and the female rotors 202.1, 202.2, the refrigerant from the evaporator 250 as shown in FIG. 2A is sucked into the inlets 210.1, 210.2 through the pipes 269.1, 269.2, respectively. The two streams of refrigerant move from the inlets 210.1, 210.2 to the outlets 211.1, 211.2. towards each other while they are being compressed. These two compressed streams are combined as one compressed stream at the combined outlet 211, which is led to the pipe 270 as shown in FIG. 2B.

Figure 3A:
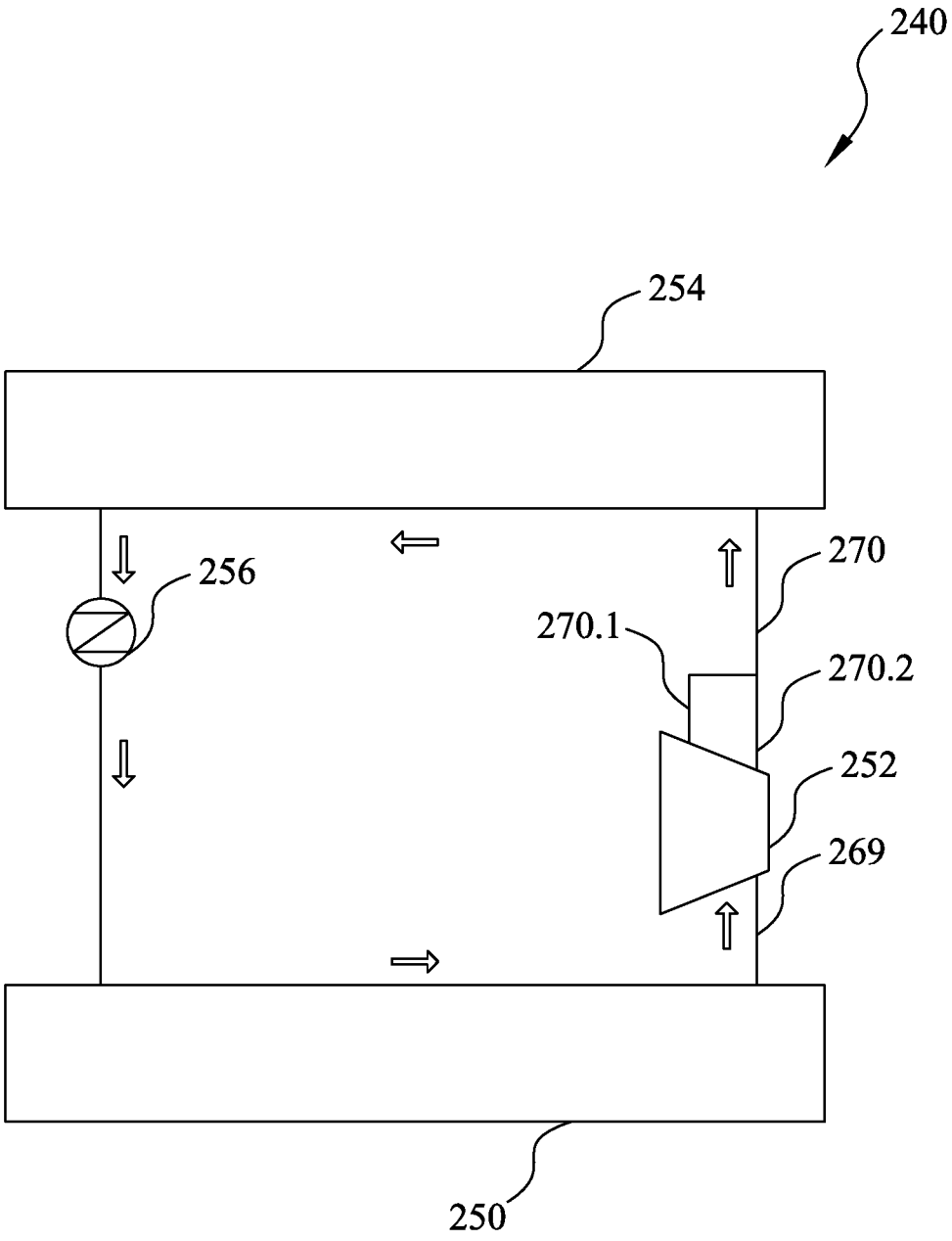
FIG. 3A shows an illustrative block diagram of a refrigeration air-conditioning unit 240 according to the second embodiment in the present application.

FIG. 3A shows an illustrative block diagram of a refrigeration air-conditioning unit 240 according to the third embodiment in the present application, in which the screw compressor 252 is used according to the present application. As shown in FIG. 3A, the refrigeration air-conditioning unit 240 has the same structure as that in FIG. 2A except some pipe connections to the compressor 252. Specifically, in FIG. 3A, the evaporator 250 is connected to the compressor 252 via the pipe 269 and the compressor 252 is connected to the condenser 254 via pipes 270.1, 270.2, which are combined into one pipe 270. The refrigerant flows through the evaporator 250, compressor 252, condenser 254 and the throttling apparatus 256 in the same fashion as described in connection with FIG. 2A.

Figure 3B:
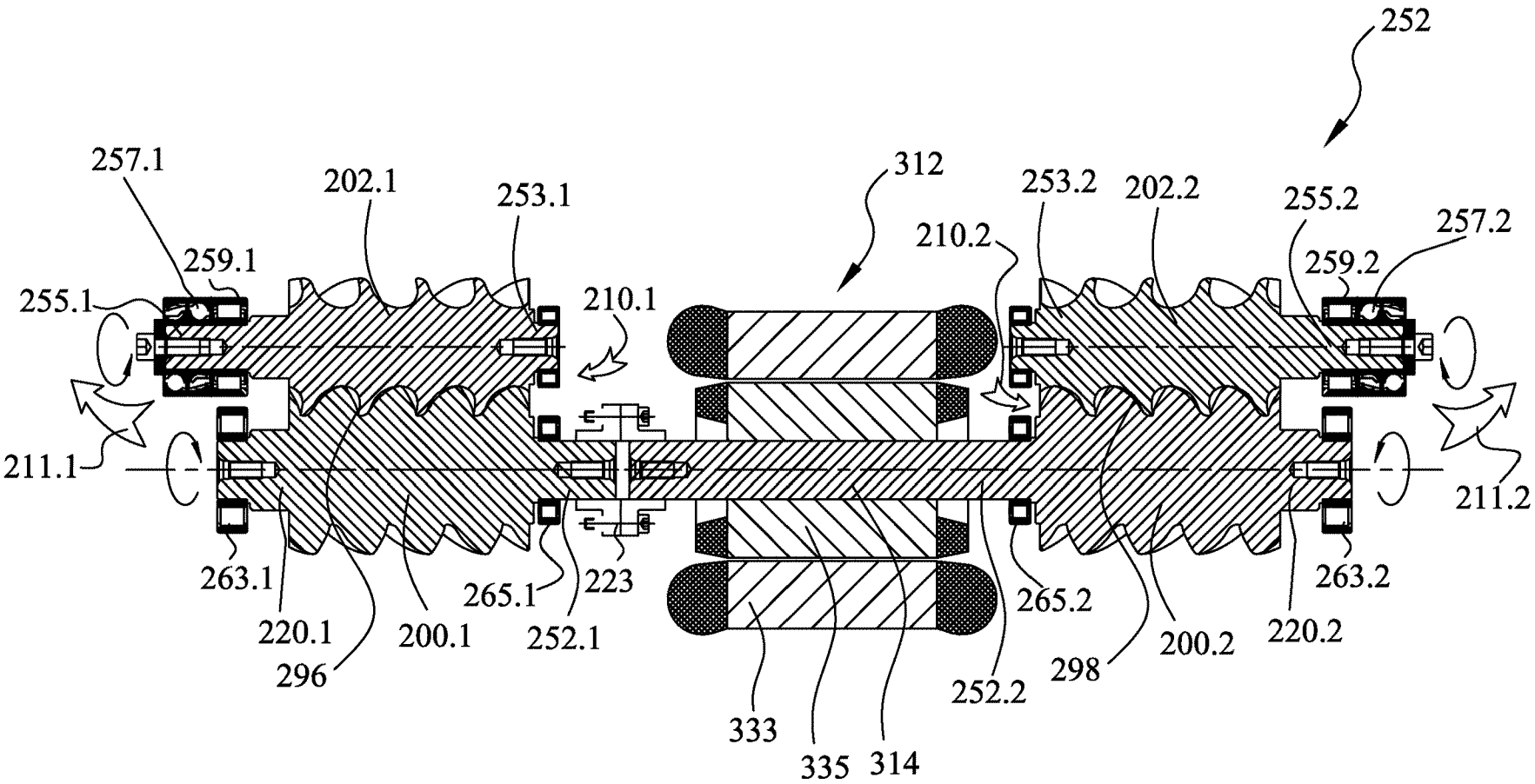
FIG. 3B shows the compressor 252 of FIG. 2A in greater detail according to the third embodiment of the present application.

FIG. 3B shows the compressor 252 of FIG. 2A in greater detail according to the third embodiment of the present application. As shown in FIG. 3B, the third embodiment also comprises the male rotors 200.1, 200.2 and female rotors 202.1, 202.2 as those the in the first embodiment of compressor 252 shown in FIG. 2B. However, in the third embodiment, the male rotors 200.1, 200.2 and female rotors 202.1, 202.2 are reversely installed comparing with the male rotors 200.1, 200.2 and female rotors 202.1, 202.2 shown in FIG. 2B.

Specifically, in FIG. 3B, the entry ends 252.1, 252.2 of the male rotors 200.1, 200.2 are rigidly connected together by using rigid shaft coupling or rigid union joint 223 and the entry ends 253.1, 253.2 of the female rotors 202.1, 202.2 are installed above the entry ends 252.1, 252.2 of the male rotors 200.1, 200.2. The entry ends 253.1, 253.2 of the female rotors 202.1, 202.2 are oppositely facing each other such that the inlets 210.1, 210.2 are arranged among the four entry ends 252.1, 252.2, 253.1, 253.2 of the four rotors 200.1, 200.2, 202.1, 202.2, respectively. As shown in FIG. 3B, the discharge ends 220.1, 255.1 of the male rotor 200.1 and female rotor 202.1 are arranged at one end of the compressor 252 while the discharge ends 220.2, 255.2 of the male rotor 200.2 and female rotor 202.2 are arranged at the other end of the compressor 252 such that the outlets 211.1 and 211.2 are arranged at the two ends of the compressor 252. By contrast, in FIG. 2B, the discharge ends 220.1, 220.2 of the male rotors 200.1, 200.2 are rigidly connected together by using rigid shaft coupling or rigid union joint 223. The discharge ends 255.1, 255.2 are installed above the discharge ends 220.1, 220.2 of the male rotors 200.1, 200.2 and are oppositely facing each other such that the outlets 211.1, 211.2 are arranged among the four discharge ends 220.2, 220.2, 255.1, 255.2 of the four rotors 200.1, 200.2, 202.1, 202.2, respectively. As shown in FIG. 2B, the entry ends 252.1, 253.1 of the male rotor 200.1 and female rotor 202.1 are arranged at one end of the compressor 252 while the entry ends 252.2, 253.2 of the male rotor 200.2 and female rotor 202.2 are arranged at the other end of the compressor 252 such that the inlets 210.1 and 210.2 are arranged at the two ends of the compressor 252.

In FIG. 3B, the four convex-helical teeth on the male rotor 200.1, 200.2 and the six concave-helical teeth on the female rotor 202.1, 202.2 are arranged such that, during rotation of the male rotor 200.1, 200.2 and the female rotor 202.1, 202.2, two streams of refrigerant are respectively sucked into the inlets 210.1, 210.2 and are being compressed within the compress chambers (which can be deemed as a first compress channel 296) between the male rotor 200.1 and female rotor 202.1 and within the compress chambers (which can be deemed as a second compress channel 298) between the male rotor 200.2 and female rotor 202.2. One of the two streams flows from the inlet 210.1 to the outlet 211.1 and is pushed out of the outlet 211.1 as high pressure refrigerant. The other one of the two streams flows from the inlet 210.2 to the outlet 211.2 and is pushed out of the outlet 211.2 as high pressure refrigerant. In the embodiment of FIG. 3B, the two streams of the compressed refrigerant flow away from each other, therefore the forces exerted on the two male rotors 200.1, 200.2 along an axial direction counteract with each other during the operation of the screw compressor 252 because the entry ends 252.1, 252.2 of the two male rotors 200.1, 200.2 are rigidly coupled together, which can generate at least the same advantageous technical results as described in connection with FIG. 2B.

In the embedment as shown in FIG. 3B, a motor 312 is installed on the shaft 314 between the male rotors 200.1, 200.2 near the rigid shaft coupling or rigid union joint 223, which drives the shaft 314 to rotate the male rotors 200.1, 200.2. The motor 312 comprises a stator 333 and a rotor 335, which is mounted on the shaft 314 between the male rotors 200.1, 200.2 near the rigid shaft coupling or rigid union joint 223. Because the male motors 200.1, 200.2 are mounted between the two male rotors 200.1, 200.2, it can apply rotation torque onto the two male rotors 200.1, 200.2 in a more balanced and smooth fashion.

In FIG. 3B, the motor 312 is not amounted on traditional cantilever mechanism, but is mounted on the shaft 314 which is located in the middle location of the male rotors 200.1, 200.2. Such an arrangement according to the embodiment in FIG. 3B does not produce, or produce lees, bending torque on the shaft 314. The deflection on the rotating shaft on the traditional cantilever mechanism can cause the stator and rotor off the rotating center of the rotating shaft on the traditional cantilever mechanism, which can cause vibration and electromagnetic noise or in worse situation can cause friction between the stator and rotor of the motor. The embodiment shown in FIG. 3B can overcome the shortcomings in the traditional cantilever mechanism.

Figure 3C:
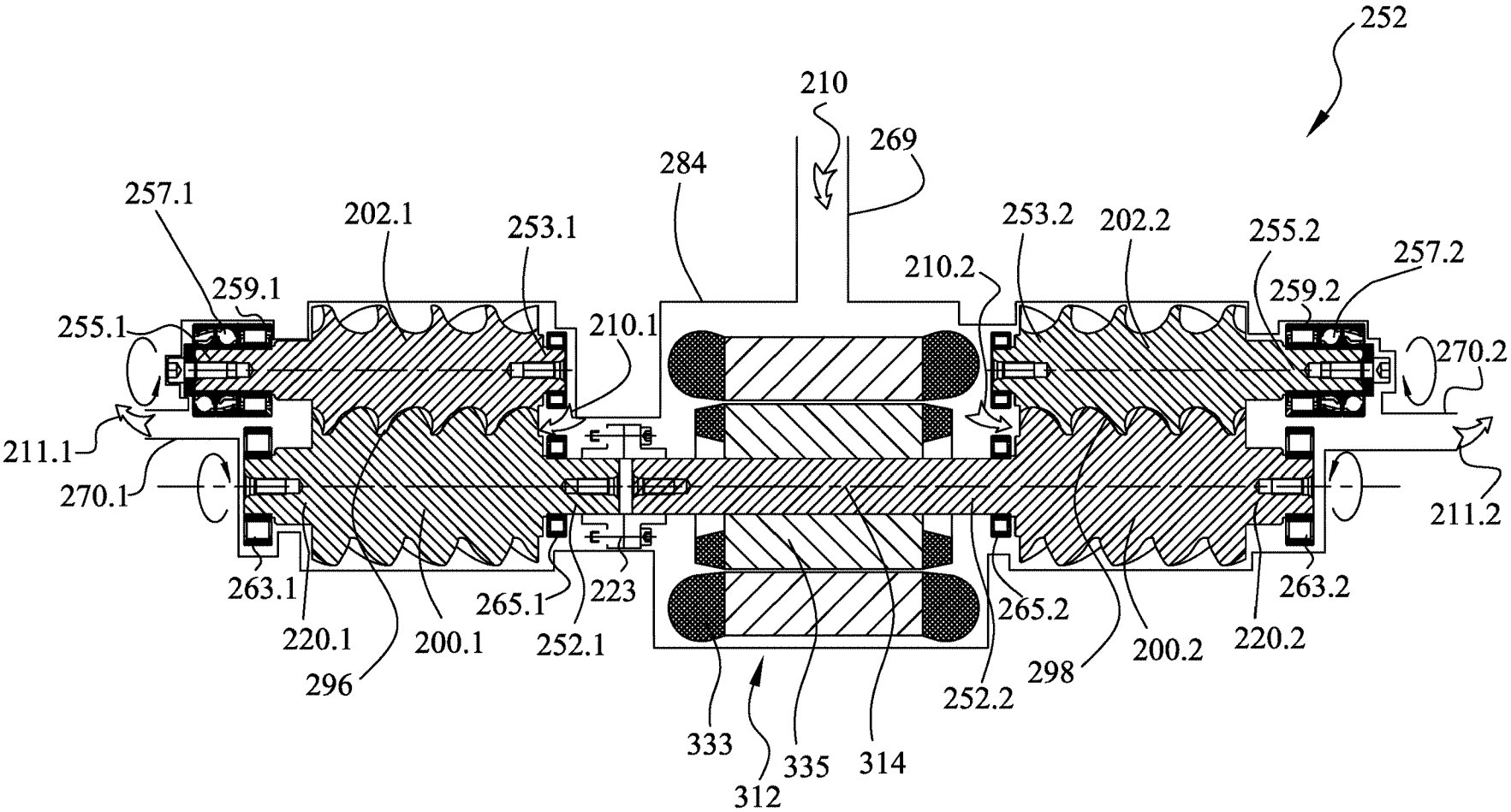
FIG. 3C shows the compressor 252 of FIG. 3B in greater detail according to the fourth embodiment of the compressor 252 in the present application.

FIG. 3C shows the compressor 252 of FIG. 3B in greater detail according to the fourth embodiment of the compressor 252 in the present application. As shown in FIG. 3C, the two male rotors 200.1, 200.2, two female rotors 202.1, 202.1 and motor 312 are installed in a housing 284, which encloses these five components into a sealed environment. As shown in FIG. 3C, the housing 284 is connected to a pipe inlet 269, which is in turn connected to the compressor 252 shown in FIG. 3A in the top middle location of the housing 284; the housing 284 is also connected to the pipes 270.1, 270.2 at the two lateral sides of the housing 284, which are combined and in turn connected to the pipe 270 shown in FIG. 3A. The pipe 270 is connected to the condenser 254 shown FIG. 3A.

To describe the operation of the compressor 252 according the fourth embodiment of the compressor 252, reference is still made to FIG. 3C. In operation, the motor 312 drives the shaft 314 so that the male rotors 200.1, 200.2 rotate in counter clockwise direction, which in turn drives the female rotors 202.1, 202.2 to rotate in clockwise direction through the engagements between the convex-helical teeth on the male rotors 200.1, 200.2 and the concave-helical teeth on the female rotors 202.1, 202.2. With the rotation of the male rotors 200.1, 200.2 and the female rotors 202.1, 202.2, a stream of refrigerant from the evaporator 250 as shown in FIG. 3A is sucked into the housing 284 via pipe 269. The stream of refrigerant is divided into two streams of refrigerant within the housing 284. One of the two streams enters into the inlet 210.1 and comes out from the outlet 211.1 as high pressure refrigerant; while the other one the two streams enters into the inlet 210.2 and comes out from the outlet 211.2 as high pressure refrigerant.

In the embodiments of the present application, the two male rotors 200.1, 200.2 can be rigidly connected together by using a rigid shaft coupling or rigid union joint, by welding them into one unit or by making them in one piece.

By arranging the two axial forces exerted on the two rotors in two opposite directions in, the embodiments of the screw compressors in the present application, the present application has at least some advantageous technical results comparing the traditional screw compressors as follows: (1) saving the thrust bearings and balance piston can saved, thus improving the durability and reliability of the screw compressors, (2) reducing the axial force exerted on the roller bearings, thus improving the life of the roller bearings which further improves the durability and reliability of the screw compressors, (3) solving the over-load and under-load issued in the traditional screw compressor, (4) counter-acting the two axial forces so that the screw compressors can run more smoothly and quietly with reduced vibrations.

Unless otherwise indicated, the technical and scientific terms used herein have identical meanings as generally understood by those skilled in the art. The terms used herein are only for purposes of describing specific embodiments, not for limiting the present disclosure. Terms like "dispose" appearing herein may indicate directly attaching one component to another, or indicate attachment of one component to another component via a middleware. A feature described in one embodiment herein may be separately, or jointly with other features, applied to another embodiment, unless otherwise indicated or this feature is not applicable in said another embodiment.

The present invention has been described through the embodiments above. However, it should be understood that the embodiments are only for exemplary and illustrative purposes, not intended to limit the present application within the scope of the described embodiments. Besides, those skilled in the art may understand that the present application is not limited to the embodiments above, and more alternation and modifications may be made according to the teaching of the present application, and all of these alterations and modifications fall within the protection scope claimed by the present application.

The invention claimed is:

1. A screw compressor, comprising:

a first male rotor and a second male rotor, each of the first male rotor and the second male rotor having two ends and convex-helical teeth, the first male rotor and the second male rotor being rigidly connected together, wherein each end of the first male rotor and the second male rotor is mounted on a respective roller bearing; and a first female rotor and a second female rotor, each of the first female rotor and the second female rotor having two additional ends and concave-helical teeth, the first female rotor and the second female rotor being arranged separately from and opposite to each other, wherein each additional end of the first female rotor and the second female rotor is mounted on a respective additional roller bearing, and wherein one of the two additional ends of each of the first female rotor and the second female rotor is mounted on a respective thrust bearing;

wherein the convex-helical teeth of the first male rotor are engaged with the concave-helical teeth of the first female rotor, and the convex-helical teeth of the second male rotor are engaged with the concave-helical teeth of the second female rotor.

2. The screw compressor according to claim 1, wherein:

a first compressing channel is formed between the first male rotor and the first female rotor, the first compressing channel has a first inlet and a first outlet, a first stream of medium flows through the first compressing channel in a first flow direction from the first inlet to the first outlet; and a second compressing channel is formed between the second male rotor and the second female rotor, the second compressing channel has a second inlet and a second outlet, a second stream of medium flows through the second compressing channel in a second flow direction from the second inlet to the second outlet.

3. The screw compressor according to claim 2, wherein:

the first stream of medium generates a first axial force that is exerted on the first male rotor when the first stream of medium is being compressed in the first compressing channel;

the second stream of medium generates a second axial force that is exerted on the second male rotor when the second stream of medium is being compressed in the second compressing channel; and the first axial force and the second axial force are opposite to each other.

4. The screw compressor according to claim 2, wherein the first stream of medium and the second stream of medium flow towards or flow away from each other.

5. The screw compressor according to claim 4, wherein the medium is refrigerant.

6. The screw compressor according to claim 2, wherein the first stream of medium and the second stream of medium are introduced from an evaporator and sent to a condenser after being compressed by the screw compressor.

7. The screw compressor according to claim 1, wherein the first male rotor and the second male rotor are rigidly connected together by a rigid shaft coupling or rigid union joint, by welding, or by being made as one piece.

8. The screw compressor according to claim 1, wherein when the first male rotor and the second male rotor rotate in a first rotation direction, the first female rotor and the second female rotor are driven by the first male rotor and the second male rotor to rotate in a second rotation direction, the first rotation direction is opposite to the second rotation direction.

9. The screw compressor according to claim 1, wherein the first male rotor, the second male rotor, the first female rotor and the second female rotor are enclosed in a housing in a sealed condition.

10. The screw compressor according to claim 1, further comprising: a motor that is amounted on a shaft between the first male rotor and the second male rotor.

11. A refrigeration air-conditioning unit, comprising:

a screw compressor, comprising:

a first male rotor and a second male rotor, each of the first male rotor and the second male rotor having convex-helical teeth, the first male rotor and the second male rotor being rigidly connected together; and a first female rotor and a second female rotor, each of the first female rotor and the second female rotor having two ends and concave-helical teeth, the first female rotor and the second female rotor being arranged separately from and opposite to each other, wherein each end of the first female rotor and the second female rotor is mounted on a respective roller bearing, wherein one of the two ends of each of the first female rotor and the second female rotor is mounted on a respective thrust bearing, and wherein only the first female rotor and the second female rotor are mounted on thrust bearings;

wherein the convex-helical teeth of the first male rotor are engaged with the concave-helical teeth of the first female rotor, and the convex-helical teeth of the second male rotor are engaged with the concave-helical teeth of the second female rotor.

12. The refrigeration air-conditioning unit according to claim 11, wherein the screw compressor comprises:

a first compressing channel is formed between the first male rotor and the first female rotor, the first compressing channel has a first inlet and a first outlet, a first stream of medium flows through the first compressing channel in a first flow direction from the first inlet to the first outlet; and a second compressing channel is formed between the second male rotor and the second female rotor, the second compressing channel has a second inlet and a second outlet, a second stream of medium flows through the second compressing channel in a second flow direction from the second inlet to the second outlet.

13. The refrigeration air-conditioning unit according to claim 12, wherein the first male rotor and the second male rotor are rigidly connected together via a shaft.

14. The refrigeration air-conditioning unit according to claim 13, comprising:

a motor mounted on the shaft extending between the first male rotor and the second male rotor.

15. The refrigeration air-conditioning unit according to claim 12, comprising:

an evaporator; and a condenser, wherein the first stream of medium and the second stream of medium are introduced from the evaporator and sent to the condenser after being compressed by the screw compressor, and wherein the first stream of medium and the second stream of medium are refrigerant.

16. The refrigeration air-conditioning unit according to claim 15, wherein the first stream of medium and the second stream of medium flow through the screw compressor away from each other.

17. The refrigeration air-conditioning unit according to claim 15, wherein the first stream of medium and the second stream of medium flow through the screw compressor towards each other.

* * * * *